US010920455B2

(12) United States Patent
Wong et al.

(10) Patent No.: US 10,920,455 B2
(45) Date of Patent: Feb. 16, 2021

(54) LOCKING MECHANISM FOR BORED LOCK

(71) Applicant: Sargent Manufacturing Company, New Haven, CT (US)

(72) Inventors: Wai P. Wong, Orange, CT (US); Michael Lorello, Guilford, CT (US); Adam O'Day, Bristol, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 16/580,035

(22) Filed: Sep. 24, 2019

(65) Prior Publication Data

US 2020/0087950 A1 Mar. 19, 2020

Related U.S. Application Data

(63) Continuation of application No. 15/911,724, filed on Mar. 5, 2018, now Pat. No. 10,465,423.
(Continued)

(51) Int. Cl.
*E05B 47/06* (2006.01)
*E05B 47/00* (2006.01)
*E05B 15/04* (2006.01)

(52) U.S. Cl.
CPC ..... *E05B 47/0657* (2013.01); *E05B 47/0012* (2013.01); *E05B 47/0661* (2013.01);
(Continued)

(58) Field of Classification Search
CPC ..... E05B 47/0657; E05B 47/0661; E05B 47/0012; E05B 2047/0023;
(Continued)

(56) References Cited

U.S. PATENT DOCUMENTS 5,083,122 A 1/1992 Clark
5,628,216 A 5/1997 Qureshi et al.
(Continued)

FOREIGN PATENT DOCUMENTS

CN 102170765 A 8/2011
TW M365969 U 10/2009
(Continued)

OTHER PUBLICATIONS

International Search Report and Written Opinion for International Application No. PCT/US2013/054352, dated Jan. 24, 2014.
(Continued)

*Primary Examiner* — Lloyd A Gall
(74) *Attorney, Agent, or Firm* — Wolf, Greenfield & Sacks, P.C.

(57) ABSTRACT

A locking mechanism for a bored lock has a lock chassis, a locking element, a motor housing, a reversible electric motor, an auger, and a spiral lock spring disposed between the locking element and the motor. The motor may drive the auger in a first or second rotational direction to move the spring towards/away from the motor to reduce/increase spring force on the locking element, thereby moving the locking element to an unlocked/locked position. One of the locking element and motor housing has a projection while the other has a guideway for slideably receiving the projection. The guideway prevents rotation of the locking element with respect to the motor as it moves between locked and unlocked positions. The projection and guideway are interlocked to prevent disassembly of the locking element and motor housing.

19 Claims, 13 Drawing Sheets

Related U.S. Application Data

(60) Provisional application No. 62/472,630, filed on Mar. 17, 2017, provisional application No. 62/468,415, filed on Mar. 8, 2017.

(52) U.S. Cl.
CPC ..... *E05B 2015/0424* (2013.01); *E05B 2015/0496* (2013.01); *E05B 2047/0014* (2013.01); *E05B 2047/0023* (2013.01)

(58) Field of Classification Search
CPC ..... E05B 2015/0424; E05B 2015/0496; E05B 2047/0014; E05B 47/0676; E05B 47/068
USPC ..... 70/277, 278.1–278.3, 278.7, 279.1, 70/280–283, 283.1; 292/144
See application file for complete search history.

(56) References Cited

U.S. PATENT DOCUMENTS

| | | | |
|---|---|---|---|
| 5,640,863 | A | 6/1997 | Frolov |
| 5,715,715 | A | 2/1998 | Nunez |
| 5,876,073 | A | 3/1999 | Geringe et al. |
| 5,931,430 | A | 8/1999 | Palmer |
| 6,076,870 | A | 6/2000 | Frolov |
| 6,082,791 | A | 7/2000 | Frolov et al. |
| 6,286,347 | B1 | 9/2001 | Frolov |
| 7,918,114 | B2 | 4/2011 | Walsh, III |
| 8,302,438 | B2 | 11/2012 | Lui |
| 8,356,499 | B2 | 1/2013 | Peng |
| 8,739,586 | B2 | 6/2014 | Yuan |
| 9,181,730 | B1 | 11/2015 | Peng |
| 9,303,433 | B2 | 4/2016 | Chiou |
| 9,316,025 | B2 | 4/2016 | Lien |
| 9,340,998 | B2 | 5/2016 | Mani |
| 9,834,959 | B2 | 12/2017 | Mani et al. |
| 10,392,836 | B2 | 8/2019 | Mani et al. |
| 10,465,423 | B2 | 11/2019 | Wong et al. |
| 2004/0099026 | A1 | 5/2004 | Nunez |
| 2005/0050928 | A1 | 3/2005 | Frolov |
| 2005/0121982 | A1 | 6/2005 | Hyde et al. |
| 2010/0031714 | A1 | 2/2010 | Brown et al. |
| 2010/0122561 | A1 | 5/2010 | Lui |
| 2010/0294008 | A1 | 11/2010 | Bogdanov |
| 2011/0056253 | A1 | 3/2011 | Greiner et al. |
| 2011/0079057 | A1 | 4/2011 | Frolov et al. |
| 2011/0203331 | A1 | 8/2011 | Picard et al. |
| 2012/0198897 | A1 | 8/2012 | Lui |
| 2012/0212001 | A1 | 8/2012 | Benitez et al. |
| 2015/0184425 | A1 | 7/2015 | Ellis et al. |
| 2016/0060904 | A1 | 3/2016 | Dore Vasudevan |
| 2018/0258666 | A1 | 9/2018 | Wong et al. |

FOREIGN PATENT DOCUMENTS

| | | | |
|---|---|---|---|
| TW | M395716 | U | 1/2011 |
| WO | WO 99/34079 | A1 | 7/1999 |

OTHER PUBLICATIONS

International Preliminary Report on Patentability for International Application No. PCT/US2013/054352, dated Feb. 26, 2015.

LOCKING MECHANISM FOR BORED LOCK

RELATED APPLICATIONS

This Application is a Continuation application and claims the benefit under 35 U.S.C. § 120 of U.S. application Ser. No. 15/911,724, filed Mar. 5, 2018, entitled "LOCKING MECHANISM FOR BORED LOCK", now U.S. Pat. No. 10,465,423, which claims the benefit under 35 U.S.C. § 119(e) of U.S. provisional application Ser. No. 62/472,630, filed Mar. 17, 2017, and U.S. provisional application Ser. No. 62/468,415, filed Mar. 8, 2017, each of which is herein incorporated by reference in its entirety.

BACKGROUND

Field

Aspects disclosed herein relate to locking device assemblies that may be used in bored, cylindrical, or tubular locks.

SUMMARY

The disclosed embodiments provide an electrified lock assembly for bored, cylindrical, or tubular locks that is less complex, more reliable, has lower energy usage, and/or is less expensive.

The disclosed embodiments also provide an electrified locking mechanism and method of assembling such locking assembly which permits the locking assembly to be inserted as a single unit to simplify and improve manufacturing of bored, cylindrical, or tubular locks.

The disclosed embodiments also provide a method of replacing a solenoid or motor in existing bored, cylindrical, or tubular locks with an electrified lock assembly that is less complex, more reliable, has lower energy usage, and/or is less expensive.

Still other objects and advantages of the disclosed embodiments will be apparent from the specification.

The above and other aspects, which will be apparent to those skilled in the art, are achieved in the embodiments disclosed herein which is/are directed to the electrified lock assembly, electrified locking mechanism, method of assembly of bored, cylindrical, or tubular locks, and method of replacing an existing assembly, for bored, cylindrical, or tubular locks as described in the specification and claims below.

BRIEF DESCRIPTION OF DRAWINGS

The features disclosed herein are believed to be novel and the elements characteristic of the claimed invention are set forth with particularity in the appended claims. The figures are for illustration purposes only and are not drawn to scale. Embodiments, both as to organization and method of operation, may best be understood by reference to the detailed description which follows taken in conjunction with the accompanying drawings in which:

DETAILED DESCRIPTION

Figure 1:
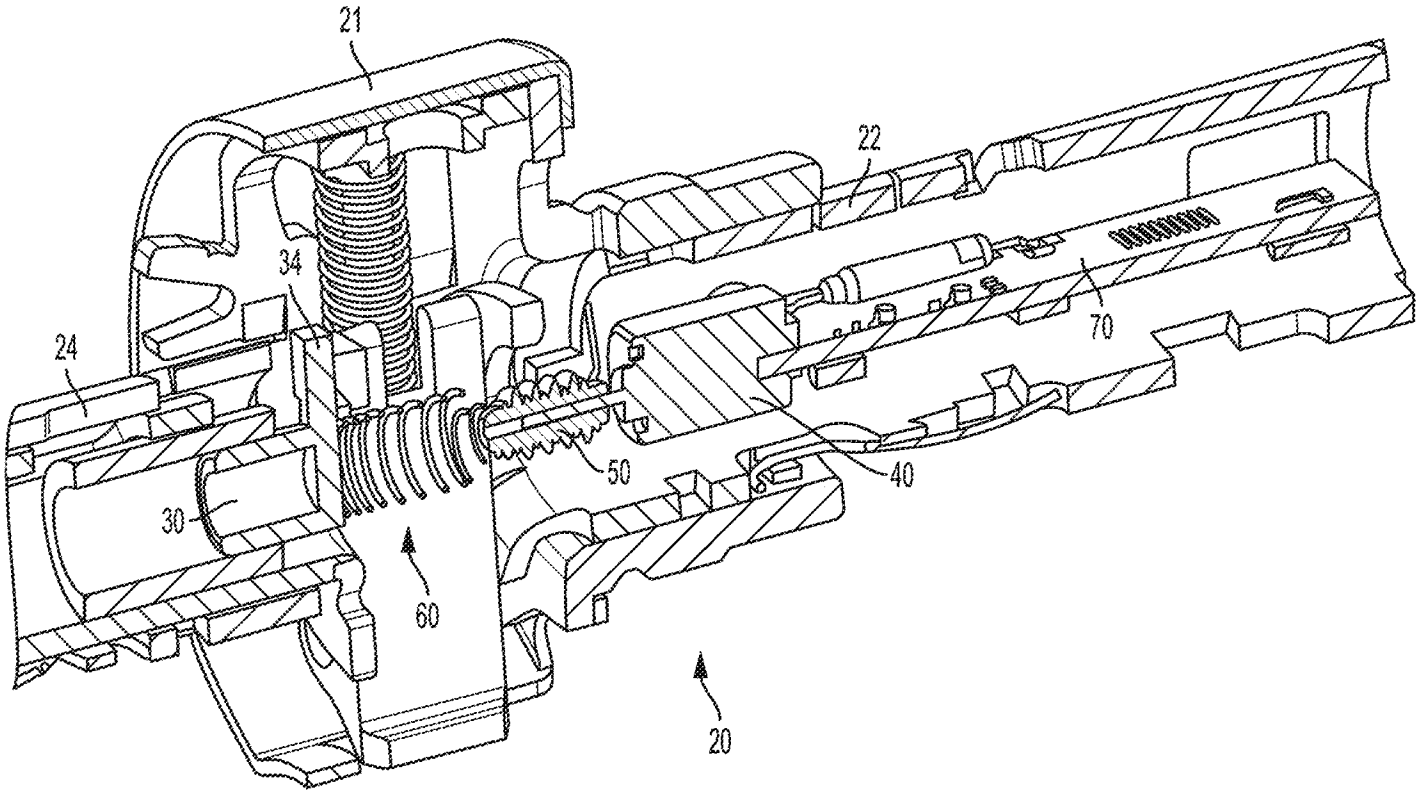
FIG. 1 is a perspective view of one embodiment of the bored lock locking mechanism.
Figure 2:
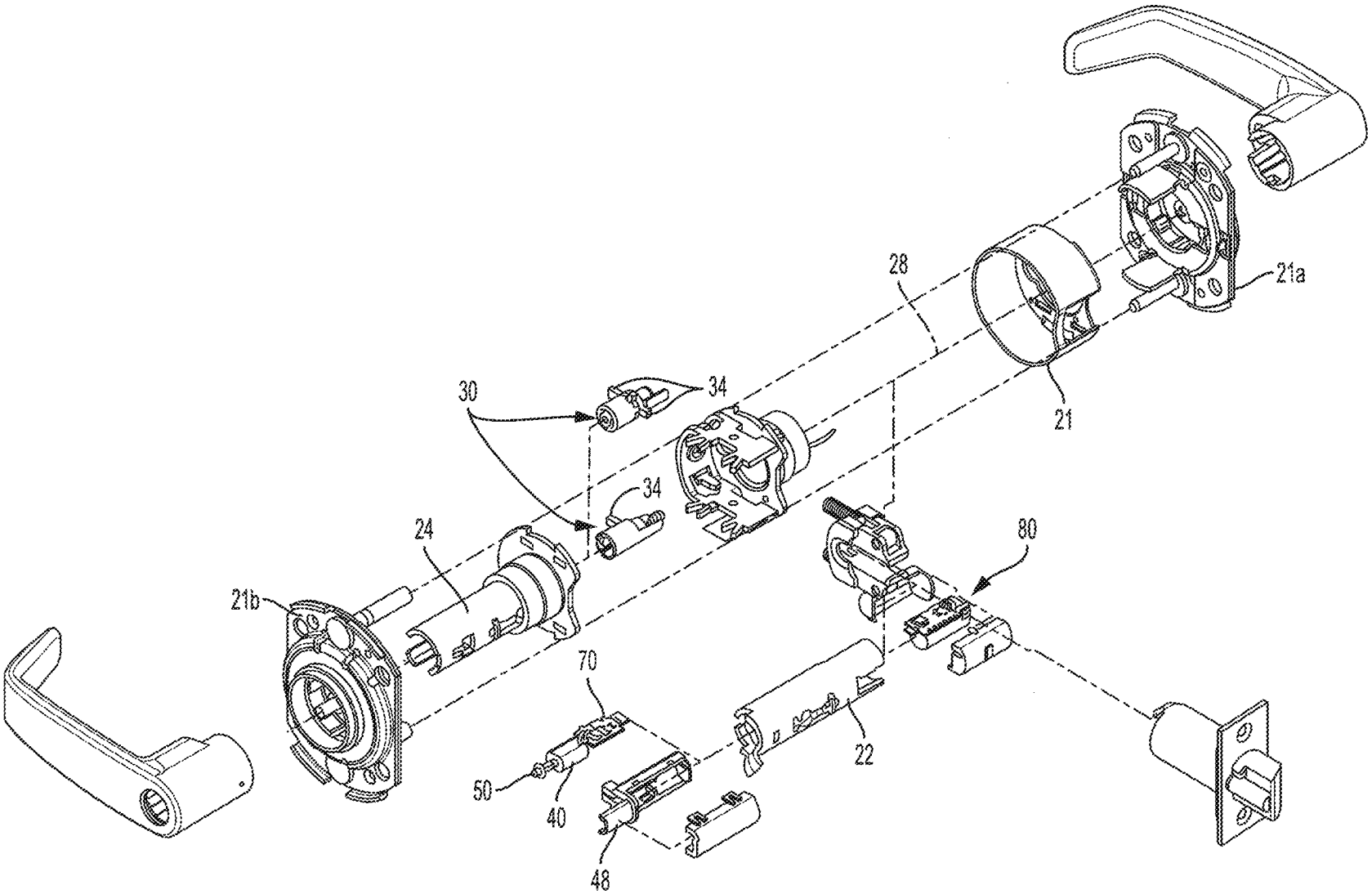
FIG. 2 is an exploded view of another embodiment of the bored lock locking mechanism.

In describing the embodiment(s), reference will be made herein to FIGS. 1-25 of the drawings in which like numerals refer to like features.

An improved electrified lock assembly, and method of replacing an existing assembly, for bored, cylindrical, or tubular locks is disclosed. Unless otherwise distinguished, these will be collectively referred to as bored locks. Embodiments described herein provides a motorized locking mechanism to control the lock and unlock of such bored locks. The mechanism includes a locking assembly, a motor and printed circuit board (hereinafter "PCB") assembly, and a capacitor unit. These three units may be packaged tightly into the limited space of an otherwise conventional bored lock assembly. The locking assembly and main motor may be interfaced and integrated through a guideway providing linear sliding motion. The motor rotation translates into linear motion through the configuration and interaction of an auger or worm gear and spring that moves the locking assembly into the locked or unlocked position. The locking assembly provides blocking to either prevent the outer spindle and lever from rotation to place the lock into the locked state, or move a clutching to permit the outer spindle and lever to freewheel and rotate to place the lock in the locked state. The motor circuitry controls the two locked/unlocked actuation positions. This circuity employs energy storage in the capacitor unit that provides either "Fail-safe" or "Fail-secure" function when the lock is power off. The capacitor unit is removable from the main motor PCB assembly via the end of the inside spindle.

As shown in the figures, a bored lock 20 has an otherwise conventional lock chassis 21 with inner and outer housing portions 21*a*, 21*b*, respectively, with a pair of spindles extending therefrom along a lock axis 28. One spindle 22 extends from housing 21*a* in a direction of the inside of the lock and receives on its end inner door handle 23, and the other spindle 24, also referred to as a rollback, extends from housing 21*b* in a direction of the outside of the lock and receives on its end outer door handle 25. Each spindle rotates about lock axis 28 within a cylindrical hub extending from its housing portion to retract the lock latch by conventional means. A locking element 30 has a peripheral groove 32 around the side or end extending toward the lock chassis, and a projection 36 extending inwardly parallel to the lock axis. Locking element 30 has an outer end sliding received within the inner end of the outer spindle 24, toward the chassis, and is slideable along the lock axis 28. An arm 34 extends axially outwardly from the locking element.

Figure 4:
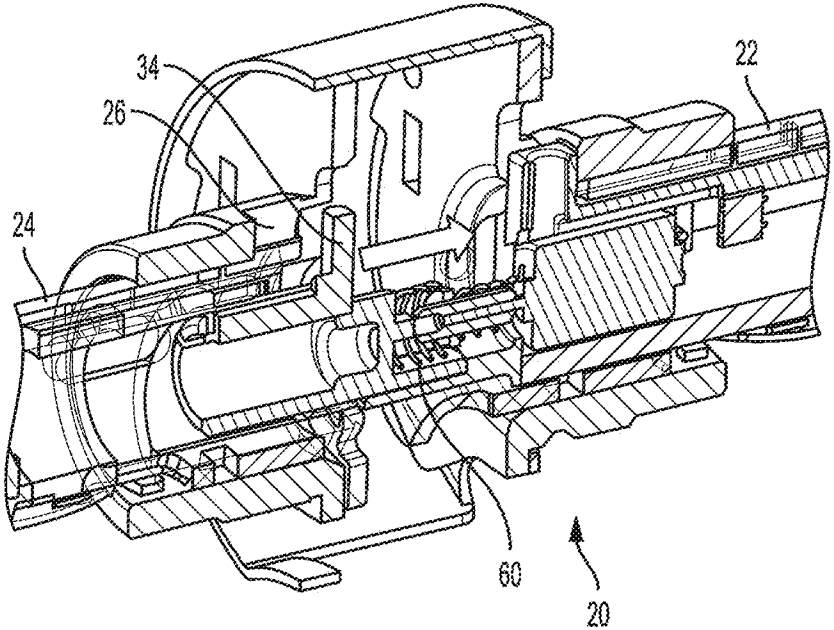
FIG. 4 is a perspective cutaway view of the locking mechanism of FIG. 3 with the lock assembly in the unlocked position.
Figure 3:
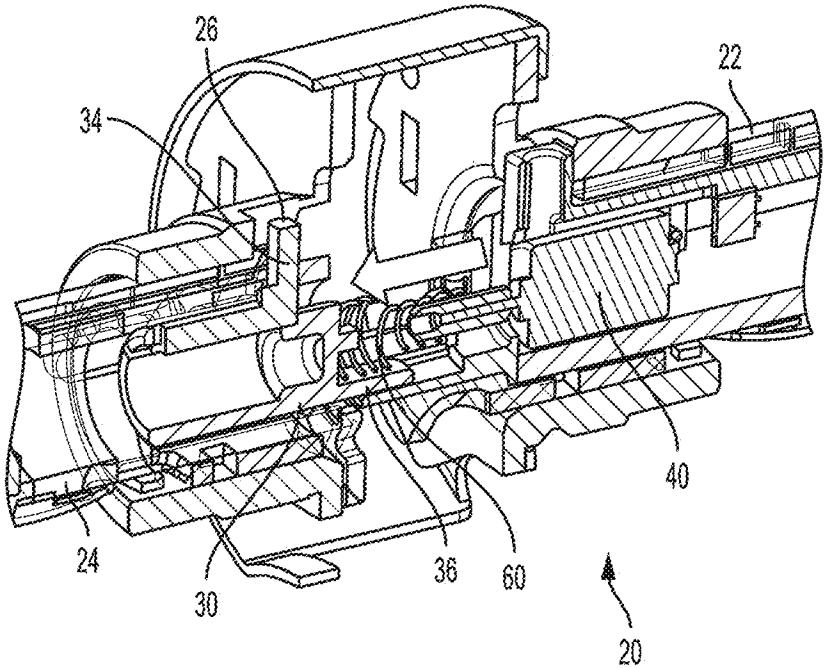
FIG. 3 is a perspective cutaway view of the locking mechanism of an embodiment of the bored lock locking mechanism with the lock assembly in the locked position.
Figure 6:
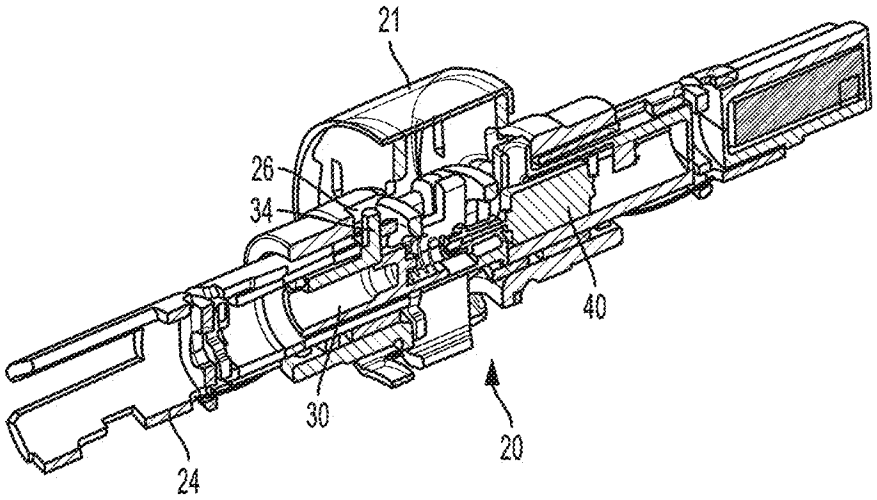
FIG. 6 is a perspective cutaway view of the locking piece of FIG. 5 with the locking mechanism in the locked position.
Figure 5:
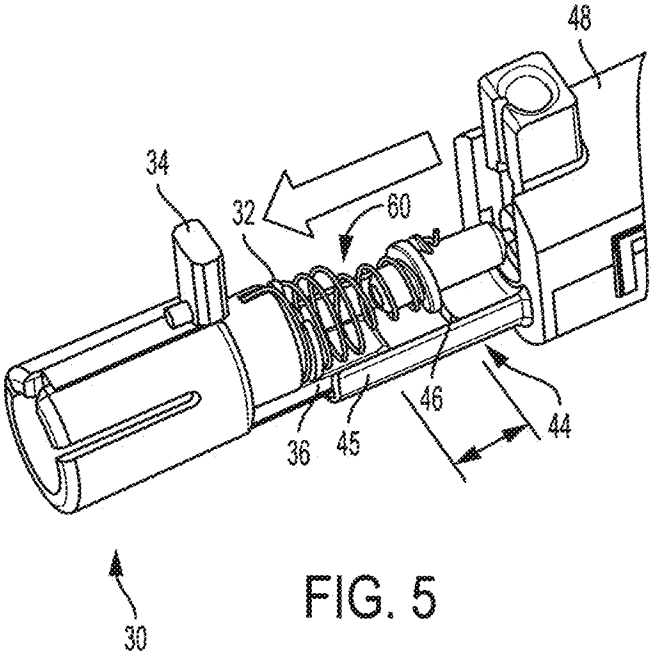
FIG. 5 is a perspective view of the locking piece of the locking mechanism of FIG. 3 moved toward the locked position.
Figure 8:
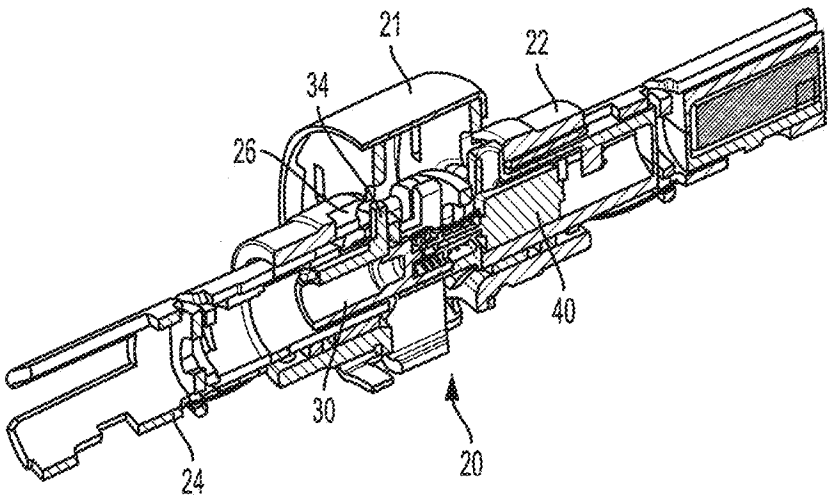
FIG. 8 is a perspective cutaway view of the locking piece of FIG. 5 with the locking mechanism in the unlocked position.
Figure 7:
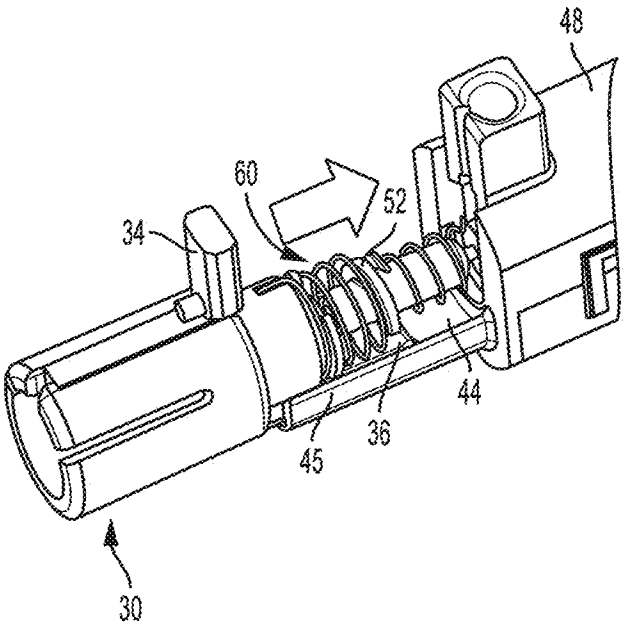
FIG. 7 is a perspective view of the locking piece of FIG. 5 moved toward the unlocked position.

In one bored lock embodiment shown in FIGS. 3-8, a single arm 34 extends from one side of locking element 30 and is slideable within a longitudinally extending groove or slot 26 in the outside spindle and chassis housing 20 hub for alternately locking and unlocking rotation of the outside spindle 24 with respect to the lock chassis. In this type of bored lock, the locked state is achieved by preventing rotation of the outer spindle 24. In this type of lock, when the locking element and arm 34 are extended away from motor 40 as a result of the motorized worm gear pushing spring 60, and translated outwardly toward the outer spindle 24, the arm 34 moves within the outer spindle groove or slot 26 to the lock position, and rotation of the arm 34 and outside spindle 24 are blocked and the door latch may not be retracted, as shown in FIGS. 3 and 6. Conversely, when the locking element and arm are retracted toward motor 40 as a result of the motorized worm gear pulling spring 60, and translated inwardly away from outer spindle 24, the arm 34 is removed from the outer spindle groove or slot 26 and the outer spindle 24 is free to rotate and retract the door latch, as shown in FIGS. 4 and 8.

Figure 10:
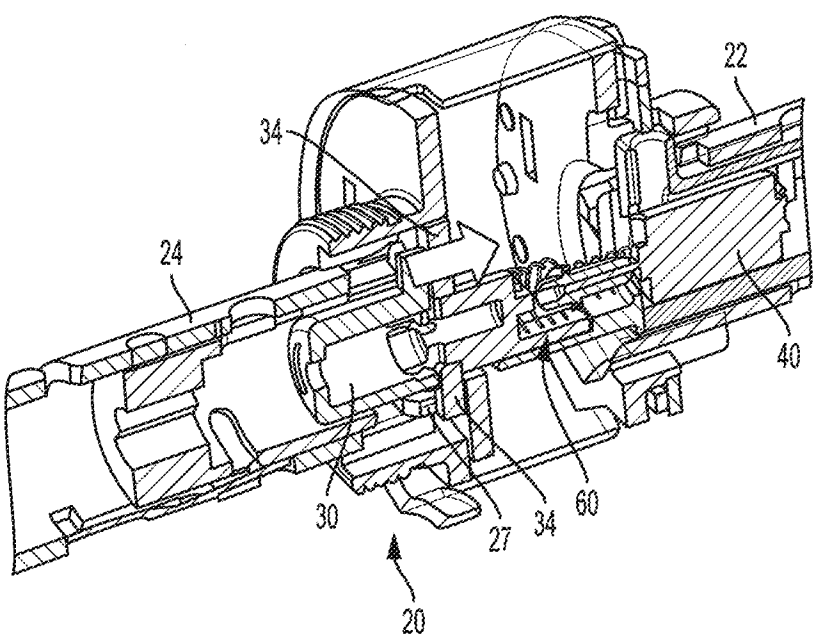
FIG. 10 is a perspective cutaway view of the locking mechanism of FIG. 9 with the lock assembly in the unlocked position.
Figure 9:
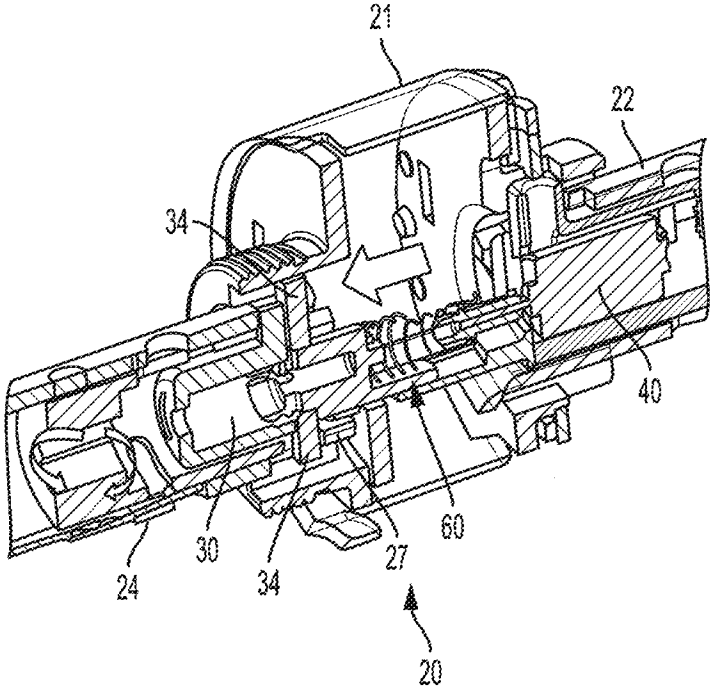
FIG. 9 is a perspective cutaway view of a further embodiment of the bored lock locking mechanism with the lock assembly in the locked position.
Figure 12:
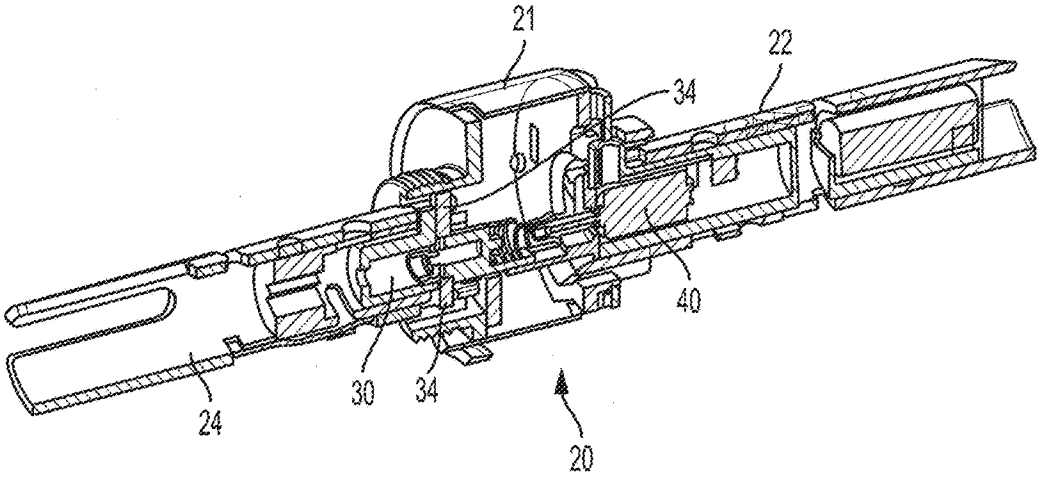
FIG. 12 is a perspective cutaway view of the locking piece of FIG. 11 with the locking mechanism in the locked position.
Figure 11:
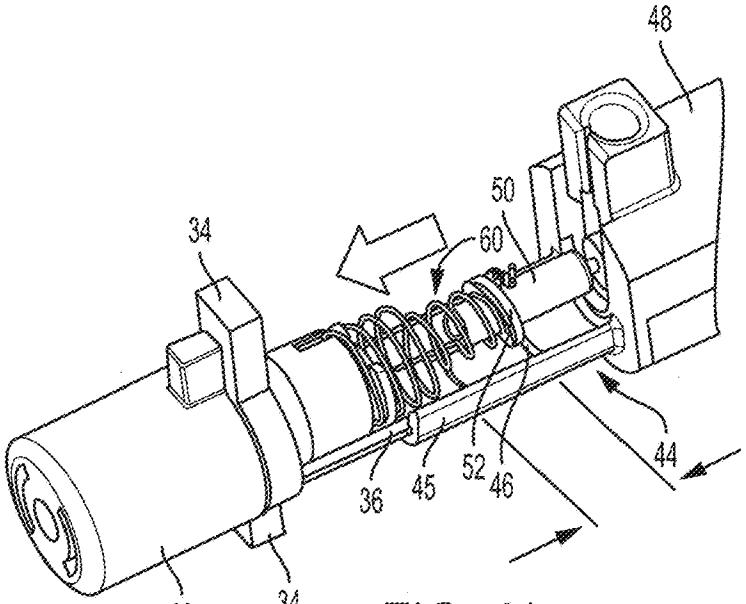
FIG. 11 is a perspective view of the locking piece of the locking mechanism of FIG. 9 moved toward the locked position.
Figure 14:
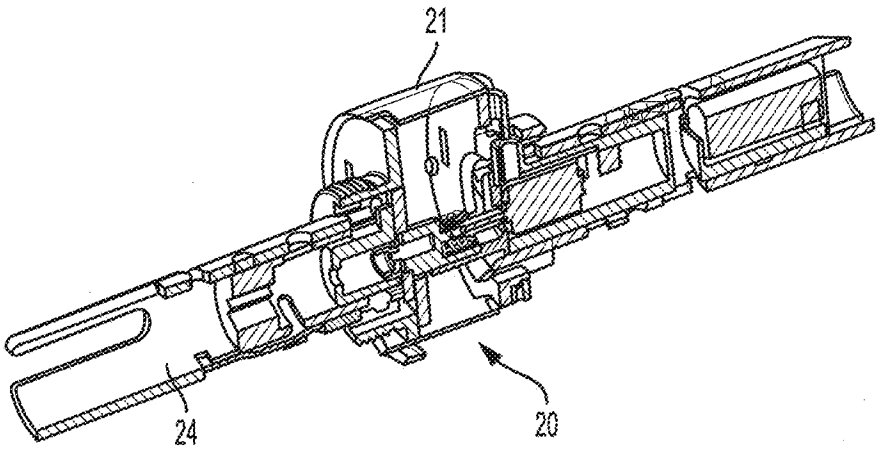
FIG. 14 is a perspective cutaway view of the locking piece of FIG. 9 with the locking mechanism in the unlocked position.
Figure 13:
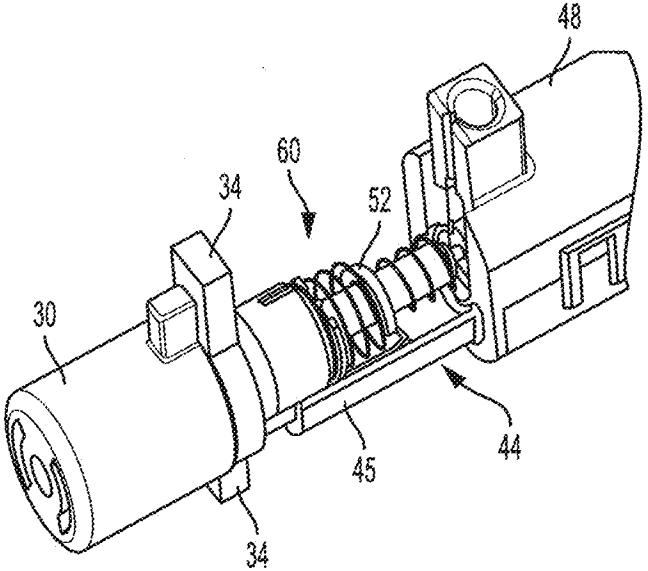
FIG. 13 is a perspective view of the locking piece of FIG. 11 moved toward the unlocked position.
Figure 17:
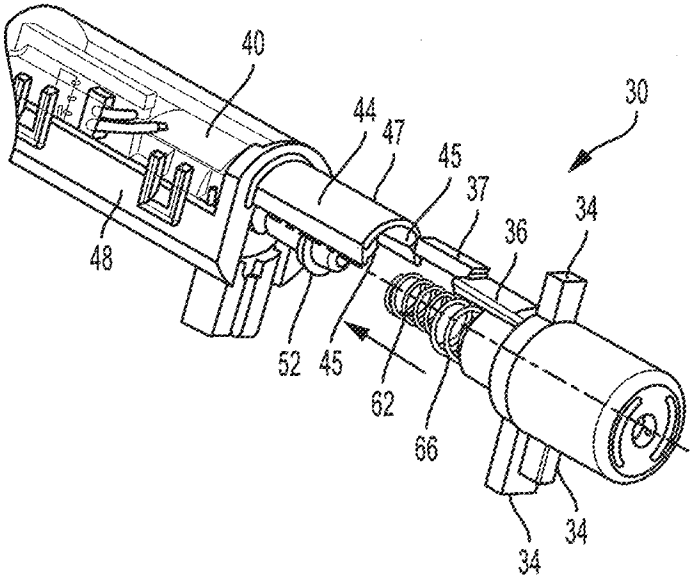
FIG. 17 is an exploded perspective view of the locking mechanism of FIG. 15.
Figure 15:
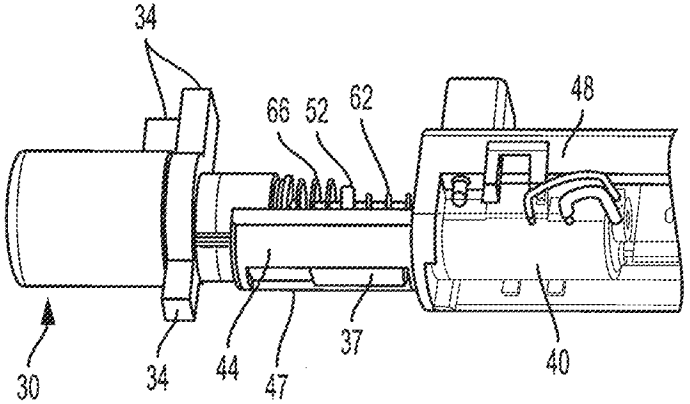
FIG. 15 is a perspective view of the locking piece of FIG. 9 employing another embodiment of the guideway linking with the motor housing of the locking mechanism, in the retracted unlocked position.
Figure 16:
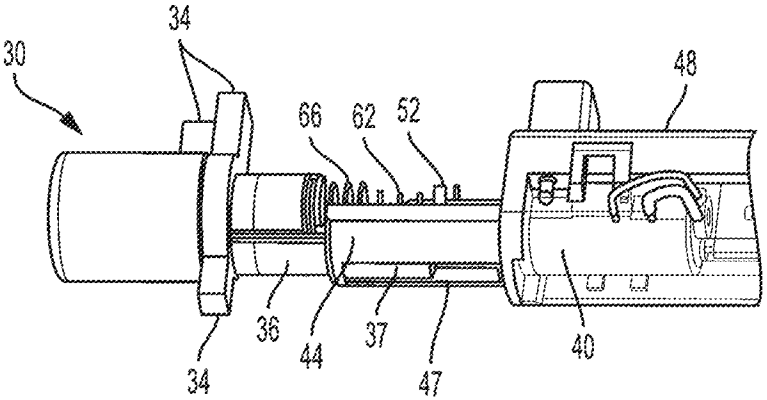
FIG. 16 is a perspective view of the locking mechanism of FIG. 15, in the extended locked position.
Figure 18A:
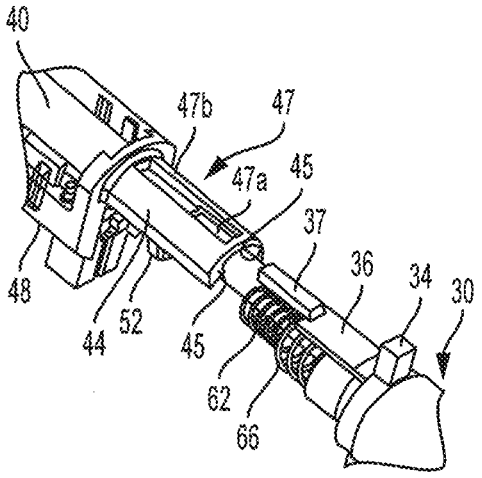
FIG. 18*a* is a top exploded perspective view of the locking mechanism of FIG. 15.
Figure 18B:
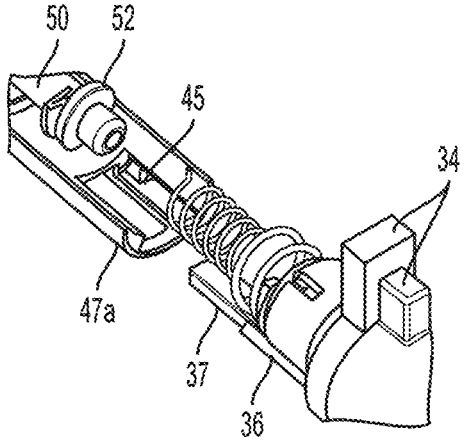
FIG. 18*b* is a bottom exploded perspective view of the locking mechanism of FIG. 15.

In another type of bored lock, shown in FIGS. 9-14, a pair of arms 34 extend from opposite sides of locking element 30, with one arm being stepped. The locked state is achieved by disengaging the outer spindle 24, and permitting it to freewheel or rotate freely. In this type of lock, when the locking element and arms 34 are translated inwardly, they may rotate within a peripheral groove adjacent clutch 27 to disengage the outer spindle from the door latch as shown in FIG. 9, and rotation of the outer spindle cannot retract the door latch, so it remains locked. When the locking element and arms 34 are retracted toward the motor and translated inwardly, the arms are removed from the outer spindle groove to engage clutch 27 as shown in FIG. 10 and the outer spindle is reconnected to the door latch, so that rotation of the outer spindle may retract the door latch.

As shown in FIGS. 5, 7, 11 and 13 and elsewhere in the drawings, a reversible electric motor 40 is disposed in a housing 48 inside inner spindle 22 and has a central shaft 42 rotatable about lock axis 28. A guideway 44 extends from the motor housing 48 toward the outer spindle, and has sides that wrap upward forming elongated flanges that function as tracks that slidingly receive the edges of locking element projection 36, to prevent relative rotation of the motor housing and locking element around axis 28. Alternately, the locking element may have the guideway with tracks receiving a projection extending from the motor housing. Linear motion of the locking element and motor housing toward each other may be limited by a stop 46 in guideway 44 contacting and blocking the end of projection 36, or by the end of guideway 44 contacting a portion of locking element 30. An auger or worm gear 50 is attached to shaft 42 and is driven by electric motor 40. The auger has a spiral thread crest 52 of essentially constant diameter and a spiral root 54 of essentially constant diameter adjacent the thread crest. Along its length, the auger may have only one (or a partial) thread extending around its periphery, or it may have a plurality of threads extending around its periphery with a plurality of roots between adjacent thread crests.

An alternate embodiment of the guideway linking and integrating the motor housing 48 and locking element 30 is shown in FIGS. 15-21. This embodiment employs the same type of locking element 30 as the embodiment of FIGS. 9-14, and may be used for the types of bored locks which permit the outer spindle to freewheel in the locked state. Locking element projection 36 has a tab 37 extending further toward the motor assembly and offset in a direction away from axis 28, which tab is slidingly received in a longitudinally extending slot 47 in guideway 44. Guideway slot 44 has an open bottom 47*a* at the end adjacent the locking element, to enable locking element projection tab 37 to be inserted into the slot during assembly of the locking mechanism. The opposite end 47*b* of slot 44 is closed (FIG. 18*a*) to prevent tab 37 from moving toward the lock axis as the locking element slides inwardly toward the motor. Contact of the free end of tab 37 with the end of slot 47 at its closed end may provide the stop to limit travel of the projection as the locking element moves toward the motor. Since the sides of guideway 36 are held by guideway side flanges 45, and projection tab 37 moves over guideway slot closed end 47*b*, the locking element is interlocked with the motor assembly while being able to slide freely in an axial direction, without possibility of being separated from the motor housing.

Figure 19:
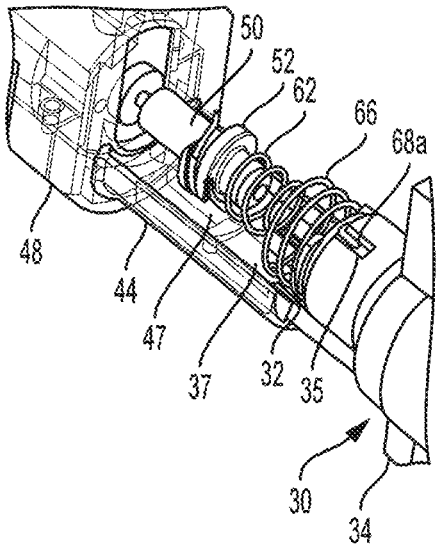
FIG. 19 is a top perspective view of the locking mechanism of FIG. 15 in the extended locked position.
Figure 20:
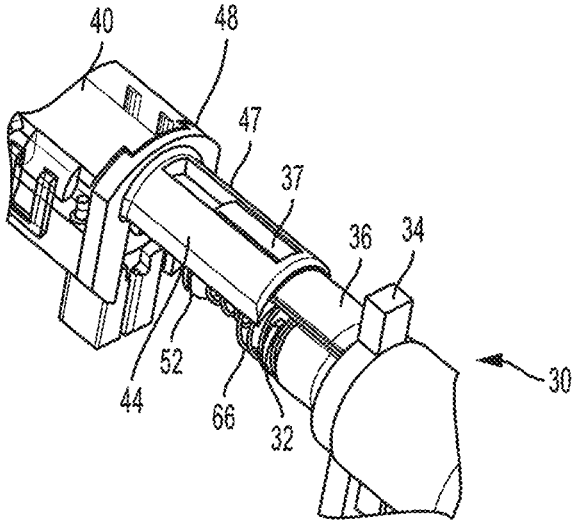
FIG. 20 is a bottom perspective view of the locking mechanism of FIG. 15 in the extended locked position.
Figure 21:
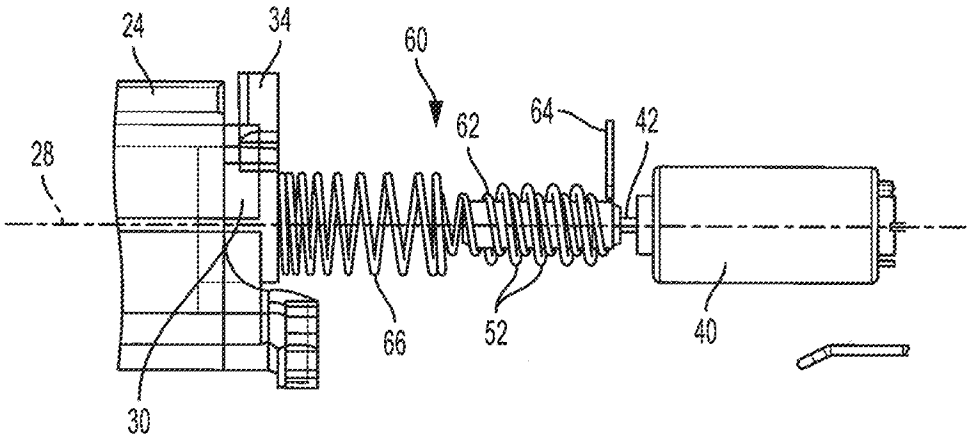
FIG. 21 is a side elevational view of an embodiment of the locking motor assembly in the retracted position.
Figure 22:
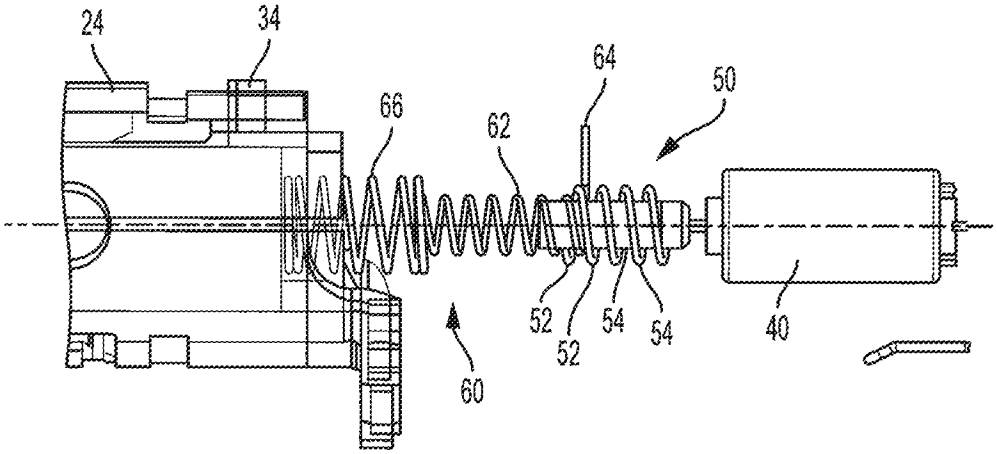
FIG. 22 is a side elevational view of the locking motor assembly, auger and spring of FIG. 21 in the extended position.

A coil lock spring 60 is disposed between locking element 30 and motor 40, as shown in FIGS. 21 and 22 and elsewhere in the drawings. Lock spring 60 has a first portion 62 with an end 64 toward the inside of the lock. End 64 is straight and extends away from the coil axis beyond the diameter of first spring portion 62. First spring portion 62 in its undeformed or resting position may have an essentially constant diameter corresponding to the diameter of the spiral root of auger 50, and a spring pitch corresponding to the pitch of the spiral thread and root of the auger. Spring first portion 62 is at least partially wound around an auger root between the auger thread crests. Lock spring 60 has a second portion 66 with an end 68 toward the outside of the lock. The second portion has an essentially constant diameter larger than the diameter of the first portion of the spring. The second portion end 68 fits within the peripheral groove 32 around the end of the locking element 30, and has a bent end 68*a* that is received in a longitudinal groove 35 in the locking element to prevent rotation of the spring (FIG. 19). The coil lock spring first portion has a greater rate or spring constant than the coil lock spring second portion. The rotary motion of the motor acting on the spring translates to a linear sliding action of the locking element 30 to lock and unlock the rollback or outer spindle 24. In FIG. 21 the locking motor assembly and spring are shown in the retracted position and in FIG. 24 in the extended position, which for the bored lock embodiments herein would correspond to the unlocked and locked positions, respectively. When spring 60 is in the retracted position (FIG. 21), there is virtually no spring compression, but when spring 60 is in the extended position (FIG. 22) urging the locking element outward, there may be only partial spring compression. This enables the spring to be compressed further in the event of unusual conditions in locking the outer spindle.

Figure 23:
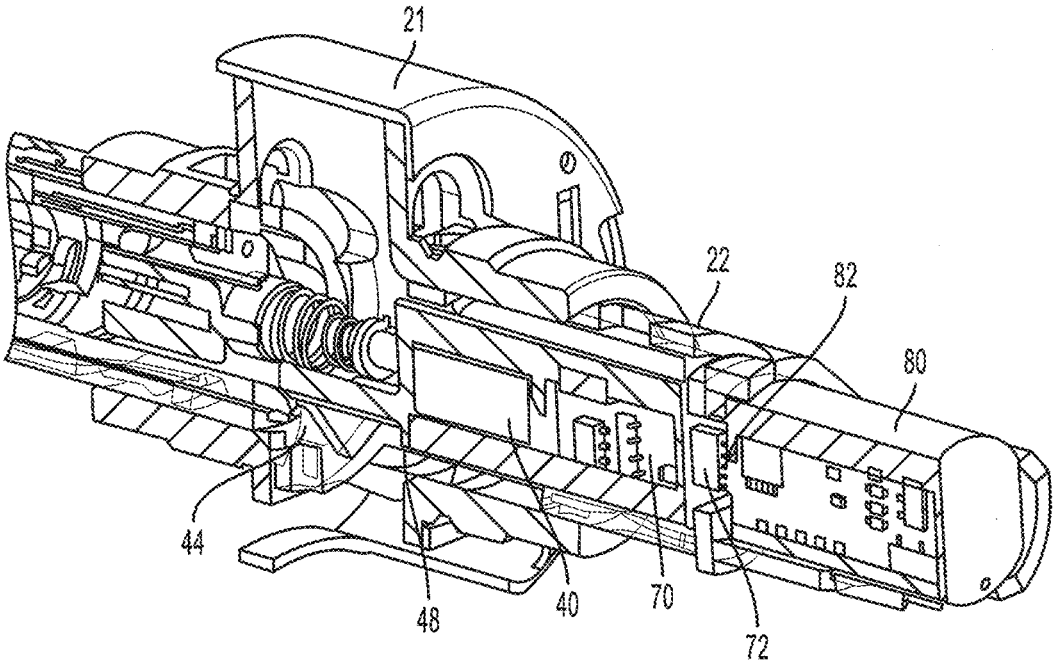
FIG. 23 is a close-up rear perspective cutaway view of an embodiment of the locking motor assembly and capacitor unit.
Figure 24:
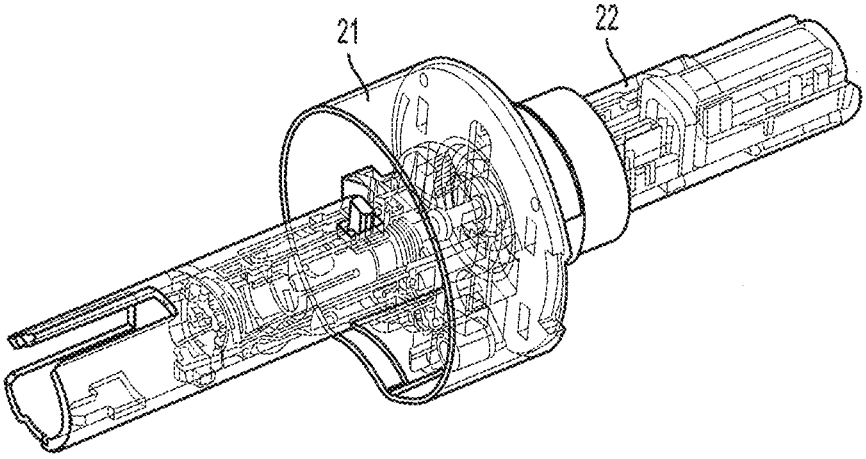
FIG. 24 is a front perspective view of the locking motor assembly and capacitor unit of FIG. 23.
Figure 25:
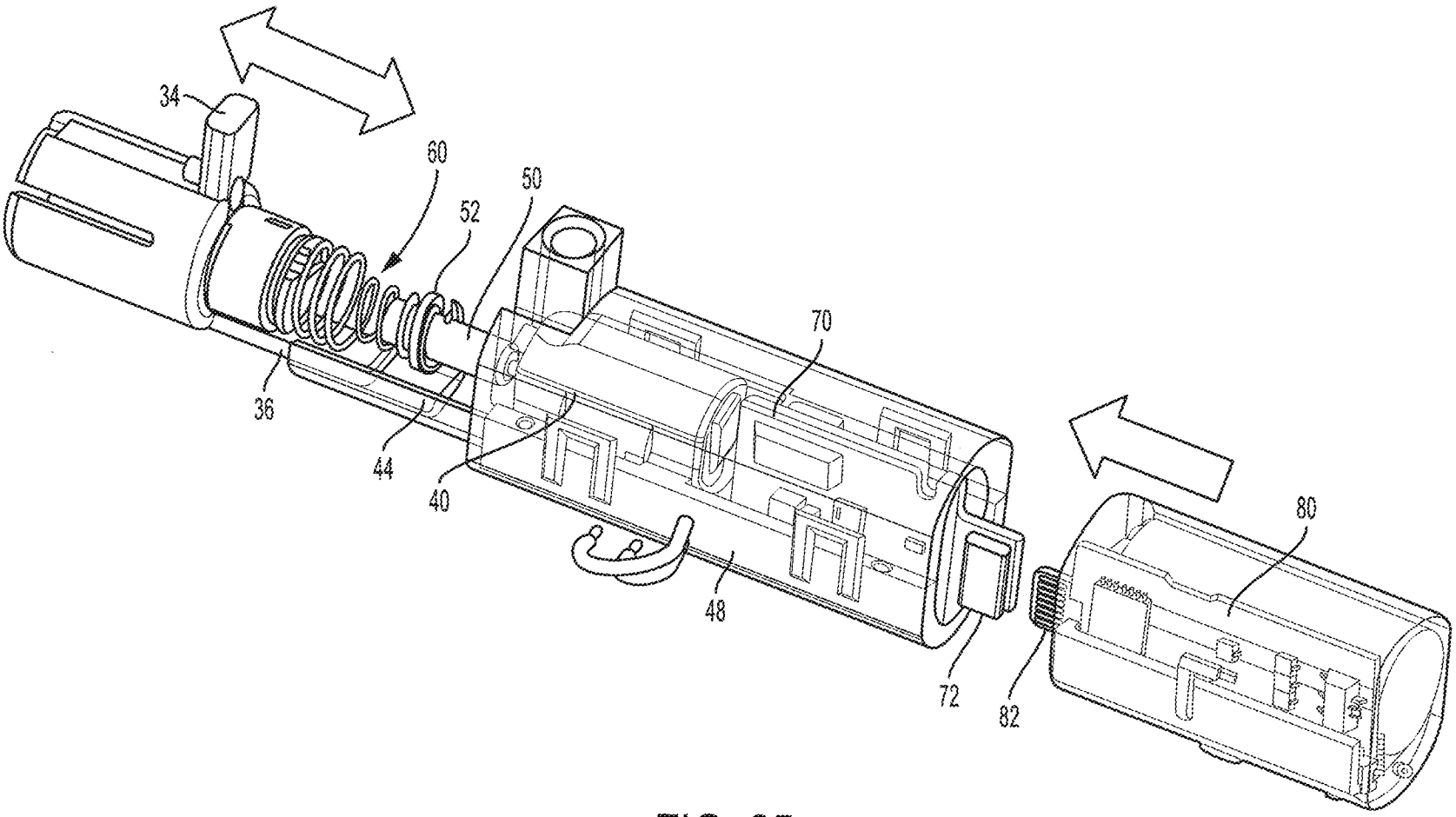
FIG. 25 is an exploded perspective view of the locking motor assembly and capacitor unit of FIG. 23.

As shown in FIGS. 23-25 and elsewhere in the drawings, PCB 70 is disposed in motor housing 48 on the inside of motor 40, and includes an electrical connector 72 for connection to a source of stored power. A replaceable capacitor 80 may be disposed within inner spindle 22 inside of PCB 72, and include a connector 82 that is linearly mateable with PCB connector 72 by sliding in the capacitor longitudinally along the lock axis. By flipping a dip switch, the circuity may provide either "Fail-safe" or "Fail-secure" function when the lock is powered off.

In operation to place lock 20 in an unlocked state electric motor 40 may drive auger 50 in a first rotational direction to move first portion 62 of spring 60 toward the motor, so that the first spring portion 62 is more fully wound between the threads of auger 50, up to a position fully covering the auger, or beyond. This moves the second spring portion 66 to a more relaxed, uncompressed position and reduces spring force on locking element 30. The locking element may then move toward the inside lock 20, to an unlocked position. The lengths of the lock assembly flange 36 and guideway 44 and the location of stop 46 on guideway 44 sets the desired limit of travel or stroke motion of the lock assembly 30 by coil lock spring 60.

To place lock 20 in a locked state motor 40 may drive the auger in a second, opposite rotational direction to move spring first portion 62 away from motor 40. As first spring portion 62 unwinds from auger 50, this effects compression of both spring portions 62 and 66, and increases spring force on locking element 30. Because of the difference in spring constants, when the electric motor drives the auger in the second rotational direction to increase spring force on the locking element, spring second portion 66 compresses to a greater degree than spring first portion 62. This spring force then slides locking element within spindle 24 toward the outside of the lock to a locked position.

Aspects may be used to assemble or even replace an existing solenoid or motor locking mechanism in a cylindrical, bored or tubular lock. If replacing, the existing solenoid or motor is first removed from the lock. The locking mechanism may be inserted with the reversible electric motor and locking element assembled as one unit interlocked by the locking element projection and tab in the motor housing guideway and slot. The motor housing end of the locking mechanism unit is inserted into the inside spindle with the auger extending toward the outside of the lock, and the coil lock spring between the locking element and the motor. The lock spring first portion of the spring is at least partially wound around the auger root between the auger thread crests, and the lock spring second portion bears against the locking element. The locking element end of the locking mechanism is inserted into the outer spindle. The electric motor may then alternately drive the auger in first and second rotational directions as described above to move the locking element between locked and unlocked positions.

The ease of assembly of the locking mechanism into the bored lock is due to the construction and operation. During assembly the projection tab is sized to pass through the guideway slot open end and during operation the projection tab slides over the guideway slot closed end as the locking element moves between locked and unlocked positions. The interlocking of the locking element projection and tab with the motor housing guideway and slot maintains the locking element, spring, auger and motor shaft in perfect alignment, to enable the entire locking mechanism to be assembled into the bored lock chassis without misaligning or coming apart. This is particularly important when subsequent lock assembly, such as crimping of the lock chassis components, may exert forces on the other lock components.

Thus, there is provided an electrified locking mechanism and lock assembly, and methods of assembling and/or replacing a solenoid or motor, for bored, cylindrical or tubular locks that is less complex, more reliable, has lower energy usage and/or is less expensive.

While the above has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the invention.

What is claimed is:

1. A bored, cylindrical or tubular lock comprising:

a locking element constructed and arranged to alternately move between an unlocked and a locked position;

a reversible electric motor operably coupled to the locking element;

an auger operably coupled to the electric motor; and a spiral lock spring disposed between the locking element and the motor, the lock spring having only a first portion having an essentially constant diameter and a second portion having an essentially constant diameter, wherein the diameter of the second portion of the spring is larger than the diameter of the first portion of the spring, the first portion of the spring being at least partially wound around the auger and the second portion of the spring contacting the locking element, wherein the electric motor is operable to drive the auger in a first rotational direction to retract the spring to a retracted position toward the motor and reduce spring force on the locking element, thereby moving the locking element to one of an unlocked or locked position, and wherein the electric motor is operable to drive the auger in a second rotational direction to extend the spring to an extended position away from the motor and increase spring force on the locking element, thereby moving the locking element to the other of the unlocked or locked position.

2. The lock of claim 1, wherein the first portion of the spiral lock spring has a greater spring constant than the second portion of the spiral lock spring, such that when the electric motor drives the auger in the second rotational direction to increase spring force on the locking element, the second portion of the lock spring compresses to a greater degree than the first portion of the spiral spring.

3. The lock of claim 1, wherein a compression on the spring when in the retracted position is less that the compression on the spring when in the extended position.

4. The lock of claim 3, wherein the spring is constructed and arranged to be further compressed beyond the extended position in the event of an unusual condition.

5. The lock of claim 1, further including a motor housing for the motor.

6. The lock of claim 5, wherein the first portion of the spiral lock spring has an end that is free from the motor housing.

7. The lock of claim 6, wherein the locking element includes a peripheral groove, and wherein an end of the second portion of the spiral lock spring fits within the peripheral groove of the locking element.

8. The lock of claim 5, further comprising a guide cooperating with the locking element and motor housing to prevent rotation of the locking element with respect to the motor.

9. The lock of claim 8, wherein the guide comprises one of the locking element and motor housing having a projection parallel to the lock axis and the other of the locking element and motor housing having a guideway for the projection, the projection being slideably received in the guideway to prevent rotation of the locking element with respect to the motor.

10. The lock of claim 9, wherein the projection and guideway are interlocked to prevent disassembly of the locking element and motor housing.

11. The lock of claim 8, wherein the guide comprises one of the locking element and motor housing having a tab and the other of the locking element and motor housing having a slot for the tab, the tab being slideably received in the slot to prevent rotation of the locking element with respect to the motor.

12. The lock of claim 1, wherein the second portion of the spiral lock spring has an end that is fixed relative to the locking element to prevent rotation of the spring with respect to the locking element.

13. The lock of claim 12, wherein the locking element includes a peripheral groove, and wherein an end of the second portion of the spiral lock spring fits within the peripheral groove of the locking element.

14. A locking mechanism for a bored, cylindrical or tubular lock comprising:

a motor housing at one end of the locking mechanism;

a reversible electric motor disposed in the motor housing;

a locking element slideable along a lock axis and constructed and arranged to alternately move between an unlocked and a locked position upon actuation by the motor; and, a guide cooperating with the locking element and motor housing to align the locking element with respect to the motor, wherein the guide comprises one of the locking element and motor housing having a projection parallel to the lock axis and the other of the locking element and motor housing having a guideway for the projection, the guideway having sides that wrap upward, the projection being slideably received in the guideway to prevent rotation of the locking element with respect to the motor.

15. The locking mechanism of claim 14, wherein the projection and guideway are interlocked to prevent disassembly of the locking element and motor housing.

16. The locking mechanism of claim 14, wherein the projection comprises a tab and the guideway comprises a slot for the tab, the tab being slideably received in the slot to prevent rotation of the locking element with respect to the motor.

17. The locking mechanism of claim 14, wherein the locking mechanism is constructed and arranged to be inserted in to the lock as one unit.

18. The locking mechanism of claim 14, further including a stop to limit travel of the projection with respect to the guideway as the locking element moves between locked and unlocked positions.

19. The locking mechanism of claim 14, wherein the guideway having sides that wrap upward comprises the guideway having sides that wrap upward to form elongated flanges, wherein the flanges function as tracks that slidingly receiving edges of the projection.

* * * * *